US008379070B2

(12) United States Patent
Morooka et al.

(10) Patent No.: US 8,379,070 B2
(45) Date of Patent: Feb. 19, 2013

(54) THERMAL HEAD, MANUFACTURING METHOD THEREFOR, AND PRINTER

(75) Inventors: Toshimitsu Morooka, Chiba (JP); Keitaro Koroishi, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 147 days.

(21) Appl. No.: 12/927,306

(22) Filed: Nov. 10, 2010

(65) Prior Publication Data

US 2011/0128340 A1 Jun. 2, 2011

(30) Foreign Application Priority Data

Nov. 30, 2009 (JP) ..... 2009-272668

(51) Int. Cl.
*B41J 2/335* (2006.01)

(52) U.S. Cl. ..... 347/200; 347/202

(58) Field of Classification Search ..... 347/200, 347/202, 206; 216/27
See application file for complete search history.

(56) References Cited

U.S. PATENT DOCUMENTS

| | | | | |
|---|---|---|---|---|
| 5,949,465 | A * | 9/1999 | Taniguchi et al. | 347/205 |
| 7,965,307 | B2 * | 6/2011 | Murakami et al. | 347/202 |
| 8,189,021 | B2 * | 5/2012 | Morooka et al. | 347/206 |
| 2009/0201355 | A1 | 8/2009 | Koyama et al. | 347/203 |
| 2010/0118105 | A1 * | 5/2010 | Morooka et al. | 347/206 |
| 2010/0231680 | A1 * | 9/2010 | Sasaki et al. | 347/206 |

FOREIGN PATENT DOCUMENTS

| | | |
|---|---|---|
| EP | 2179850 | 4/2010 |
| JP | 1108064 | 4/1989 |

* cited by examiner

*Primary Examiner* — Huan Tran
(74) *Attorney, Agent, or Firm* — Adams & Wilks

(57) ABSTRACT

A thermal head includes a support substrate having a concave portion formed in its front surface, and an upper substrate bonded in a stacked state to the front surface of the support substrate. A heating resistor is provided on the front surface of the upper substrate at a position corresponding to the concave portion. A pair of electrodes are provided on opposite sides of the heating resistor, and a convex portion is formed in the front surface of the upper substrate between the pair of electrodes. The heating resistor has a heating portion disposed between and not overlapped by the electrodes, and the heating portion directly overlies the concave portion. The convex portion has a width dimension smaller than that of the heating portion.

18 Claims, 13 Drawing Sheets

THERMAL HEAD, MANUFACTURING METHOD THEREFOR, AND PRINTER

BACKGROUND OF THE INVENTION

1. Field of the Invention

The present invention relates to a thermal head, a manufacturing method therefor, and a printer.

2. Description of the Related Art

There has been conventionally known a thermal head for use in thermal printers, which performs printing on a thermal recording medium such as paper by selectively driving a plurality of heating elements based on printing data (see, for example, Japanese Patent Application Laid-open No. 2009-119850).

In the thermal head disclosed in Japanese Patent Application Laid-open No. 2009-119850, an upper substrate is bonded to a support substrate having a concave portion formed therein and heating resistors are provided on the upper substrate so that a cavity portion is formed in a region between the upper substrate and the support substrate so as to correspond to the heating resistors. This thermal head allows the cavity portion to function as a heat-insulating layer having low thermal conductivity so as to reduce an amount of heat transferring from the heating resistors to the support substrate, to thereby increase thermal efficiency to reduce power consumption.

A printer having the above-mentioned thermal head installed therein has a pressure mechanism for pressing thermal paper against a platen roller in a sandwiched manner. In order that heat of the surface of the thermal head be effectively transferred to the thermal paper, the thermal head is pressed against the thermal paper with an appropriate pressing force. Accordingly, the thermal head is required to have strength high enough to withstand the pressing force applied by the pressure mechanism.

Further, when the thermal paper is pressed against the surface of the thermal head by the platen roller, an air layer is formed between the thermal paper and the surface of the thermal head because of steps defined between the heating resistors and electrodes provided on both sides of the heating resistors. The heat generated by the heating resistors is hindered by the air layer from transferring to the thermal paper, which is inconvenient because thermal efficiency of the thermal head may decrease.

SUMMARY OF THE INVENTION

The present invention has been made in view of the above-mentioned circumstances, and it is an object thereof to provide a thermal head with enhanced strength and increased thermal efficiency including a cavity portion formed therein at a position corresponding to a heating resistor.

In order to achieve the above-mentioned object, the present invention provides the following means.

A thermal head according to a first aspect of the present invention includes: a support substrate having a concave portion formed in its front surface; an upper substrate bonded in a stacked state to the front surface of the support substrate; a heating resistor provided on a front surface of the upper substrate at a position corresponding to the concave portion; a pair of electrodes provided on both sides of the heating resistor; and a convex portion formed in the front surface of the upper substrate on a side of the pair of electrodes, the convex portion being provided between the pair of electrodes.

According to the first aspect of the present invention, the upper substrate provided with the heating resistor functions as a heat storage layer that stores heat generated from the heating resistor. Further, the support substrate including the concave portion formed in its front surface and the upper substrate are bonded to each other in the stacked state, to thereby form a cavity portion between the support substrate and the upper substrate. The cavity portion is formed in a region corresponding to the heating resistor and functions as a heat-insulating layer that blocks the heat generated from the heating resistor. Therefore, according to the first aspect of the present invention, the heat generated from the heating resistor may be prevented from transferring and dissipating to the support substrate via the upper substrate. As a result, use efficiency of the heat generated from the heating resistor, that is, thermal efficiency of the thermal head may be increased.

Further, in the front surface of the upper substrate on the electrode side, the convex portion is formed between the pair of electrodes provided on both sides of the heating resistor so that smaller steps may be defined between the heating resistor formed on a surface of the convex portion and the electrodes provided at both ends of the heating resistor. Accordingly, an air layer to be formed between a front surface of the heating resistor and thermal paper may be reduced in size. Therefore, according to the first aspect of the present invention, the heat generated by the heating resistor may transfer to the thermal paper efficiently, to thereby increase the thermal efficiency of the thermal head to reduce an amount of energy required for printing.

When a load is applied to the upper substrate during printing, the upper substrate is deformed in a region corresponding to the concave portion, and accordingly a tensile stress occurs at a rear surface of the upper substrate in the above-mentioned region. On this occasion, the convex portion formed in the upper substrate in the region corresponding to the concave portion contributes to enhanced strength of the upper substrate, unlike an upper substrate having a uniform thickness.

According to the first aspect, the convex portion may be formed within a region corresponding to the concave portion.

With such a structure, the region of the front surface of the upper substrate corresponding to the concave portion (cavity portion) may include regions in which the convex portion is not formed, that is, regions in which the upper substrate is thin. Accordingly, an amount of heat to be taken away by the upper substrate may be reduced to increase the thermal efficiency of the thermal head.

According to the first aspect, the convex portion may be formed extending to outer regions beyond the region corresponding to the concave portion.

With such a structure, the upper substrate may be thickened in the region corresponding to the concave portion (cavity portion) to enhance the strength of the upper substrate.

According to the first aspect, the convex portion may include: a flat distal end surface; and side surfaces formed extending and inclining from both ends of the distal end surface so that the convex portion is gradually narrower toward the distal end surface.

Because the convex portion has the flat distal end surface, a load of a platen roller may be imposed over the distal end surface of the convex portion, to thereby prevent a concentrated load from being imposed on a part of the convex portion. Further, because the side surfaces are formed extending and inclining from the both ends of the distal end surface so that the convex portion may be gradually narrower toward the distal end surface, it is easy to form the heating resistor on the side surfaces of the convex portion.

According to the first aspect, the convex portion may be formed to have a height larger than a height of the pair of electrodes.

Because the height of the convex portion is larger than the height of the electrodes, an air layer to be formed between the surface of the thermal head and the thermal paper may be eliminated so that the surface of the thermal head and the thermal paper may adhere closely to each other. Accordingly, the heat generated by the heating resistor may transfer to the thermal paper efficiently, to thereby increase the thermal efficiency of the thermal head to reduce the amount of energy required for printing.

A printer according to a second aspect of the present invention includes any one of the thermal heads described above.

Because the printer includes the above-mentioned thermal head, while ensuring the strength of the upper substrate, the thermal efficiency of the thermal head may be increased to reduce the amount of energy required for printing. Therefore, printing on the thermal paper may be performed with low power to prolong battery duration. Besides, a failure due to the breakage of the upper substrate may be prevented to enhance device reliability.

A manufacturing method for a thermal head according to a third aspect of the present invention includes: forming an opening portion in a front surface of a support substrate; bonding a rear surface of an upper substrate in a stacked state to the front surface of the support substrate, which has the opening portion formed therein in the forming an opening portion; thinning the upper substrate, which is bonded to the support substrate in the bonding; forming a convex portion in the front surface of the upper substrate, which is bonded to the support substrate in the bonding; forming a heating resistor on the front surface of the upper substrate in a region corresponding to the opening portion; and forming electrode layers at both ends of the heating resistor, which is formed in the forming a heating resistor.

According to the manufacturing method for a thermal head, a thermal head may be manufactured in which the cavity portion is formed between the support substrate and the upper substrate, and the convex portion is formed between the electrode layers formed at both ends of the heating resistor. Accordingly, as described above, while ensuring the strength of the upper substrate, the thermal efficiency of the thermal head may be increased to reduce the amount of energy required for printing.

According to the present invention, the thermal head including the cavity portion formed at the position corresponding to the heating resistor may have the enhanced strength and the increased thermal efficiency.

BRIEF DESCRIPTION OF THE DRAWINGS

In the accompanying drawings:

FIGS. 4A to 4C are views illustrating how a concentrated load is applied to the thermal head of FIG. 3, in which FIG. 4A is a cross-sectional view before the load application, FIG. 4B is a cross-sectional view under the load application, and FIG. 4C is a plan view under the load application;

FIGS. 11A to 11G are views illustrating a manufacturing method for a thermal head according to the present invention, in which FIG. 11A illustrates a cavity portion forming step; FIG. 11B, a bonding step; FIG. 11C, a thinning step; FIG. 11D, a convex portion forming step; FIG. 11E, a resistor forming step; FIG. 11F, an electrode layer forming step; and FIG. 11G, a protective film forming step;

FIGS. 12A to 12G are views illustrating a manufacturing method for a thermal head according to a first modified example of FIGS. 11A to 11G, in which FIG. 12A illustrates a cavity portion forming step; FIG. 12B, a bonding step; FIG. 12C, a thinning step; FIG. 12D, a convex portion forming step; FIG. 12E, a resistor forming step; FIG. 12F, an electrode layer forming step; and FIG. 12G, a protective film forming step;

FIGS. 13A to 13G are views illustrating a manufacturing method for a thermal head according to a second modified example of FIGS. 11A to 11G, in which FIG. 13A illustrates a cavity portion forming step; FIG. 13B, a bonding step; FIG. 13C, a convex portion forming step; FIG. 13D, a thinning step; FIG. 13E, a resistor forming step; FIG. 13F, an electrode layer forming step; and FIG. 13G, a protective film forming step;

FIGS. 15A to 15C are views illustrating how a concentrated load is applied to the thermal head of FIG. 14, in which FIG. 15A is a cross-sectional view before the load application, FIG. 15B is a cross-sectional view under the load application, and FIG. 15C is a plan view under the load application.

DETAILED DESCRIPTION OF THE INVENTION

First Embodiment

A thermal head 1 and a thermal printer 10 according to a first embodiment of the present invention are described below with reference to the accompanying drawings.

Figure 1:
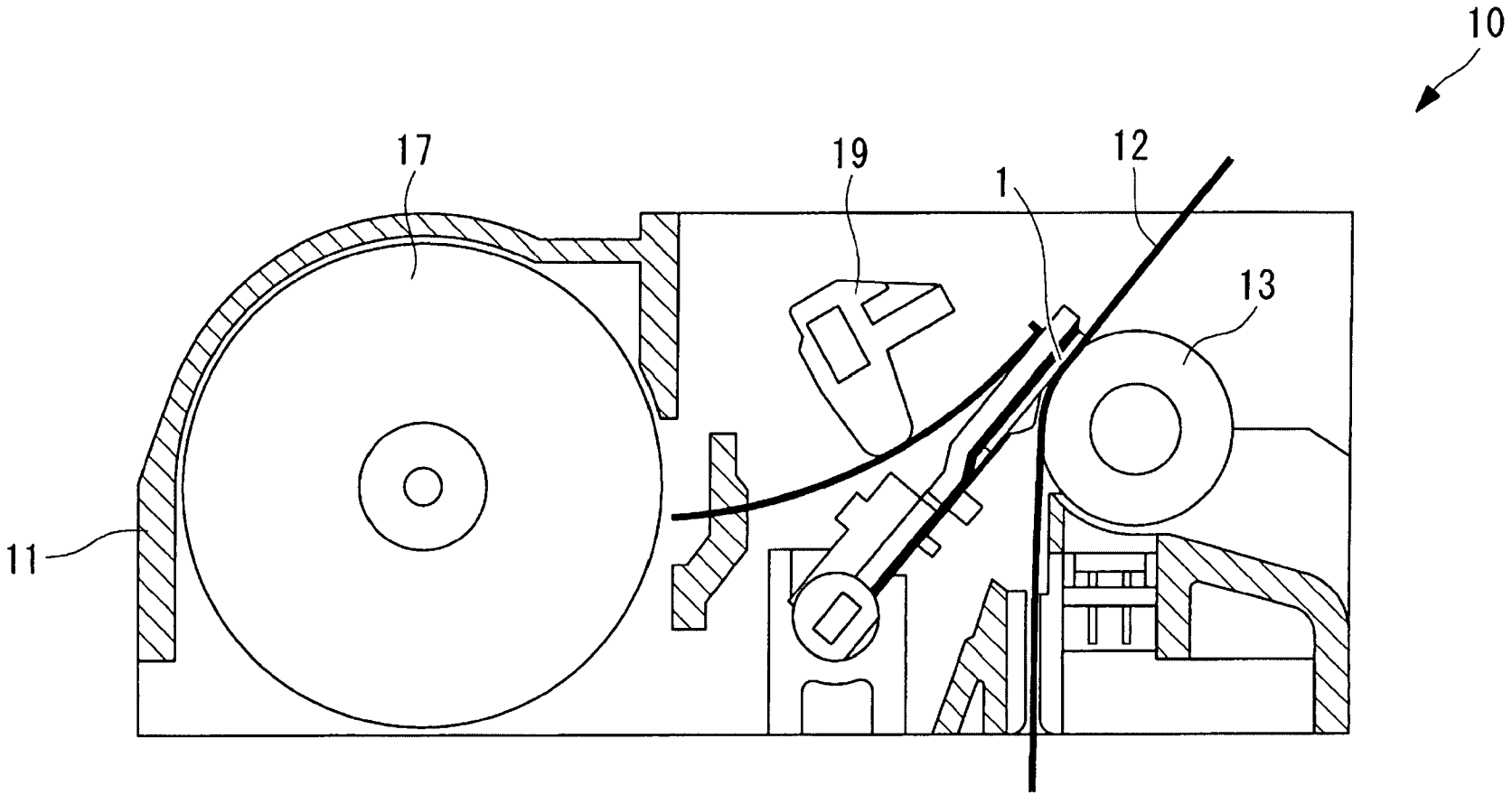
FIG. 1 is a schematic structural view of a thermal printer according to one embodiment of the present invention.

The thermal head 1 according to this embodiment is used for, for example, the thermal printer 10 as illustrated in FIG. 1, and performs printing on an object to be printed, such as thermal paper 12, by selectively driving a plurality of heating elements based on printing data.

The thermal printer 10 includes a main body frame 11, a platen roller 13 disposed with its central axis being horizontal, the thermal head 1 disposed opposite to an outer peripheral surface of the platen roller 13, a heat dissipation plate (not shown) supporting the thermal head 1, a paper feeding mechanism 17 for feeding the thermal paper 12 between the platen roller 13 and the thermal head 1, and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. Accordingly, a reaction force of the platen roller 13 is applied to the thermal head 1 via the thermal paper 12.

The heat dissipation plate is a plate-shaped member made of a metal such as aluminum, a resin, ceramics, glass, or the like, and serves for fixation and heat dissipation of the thermal head 1.

Figure 2:
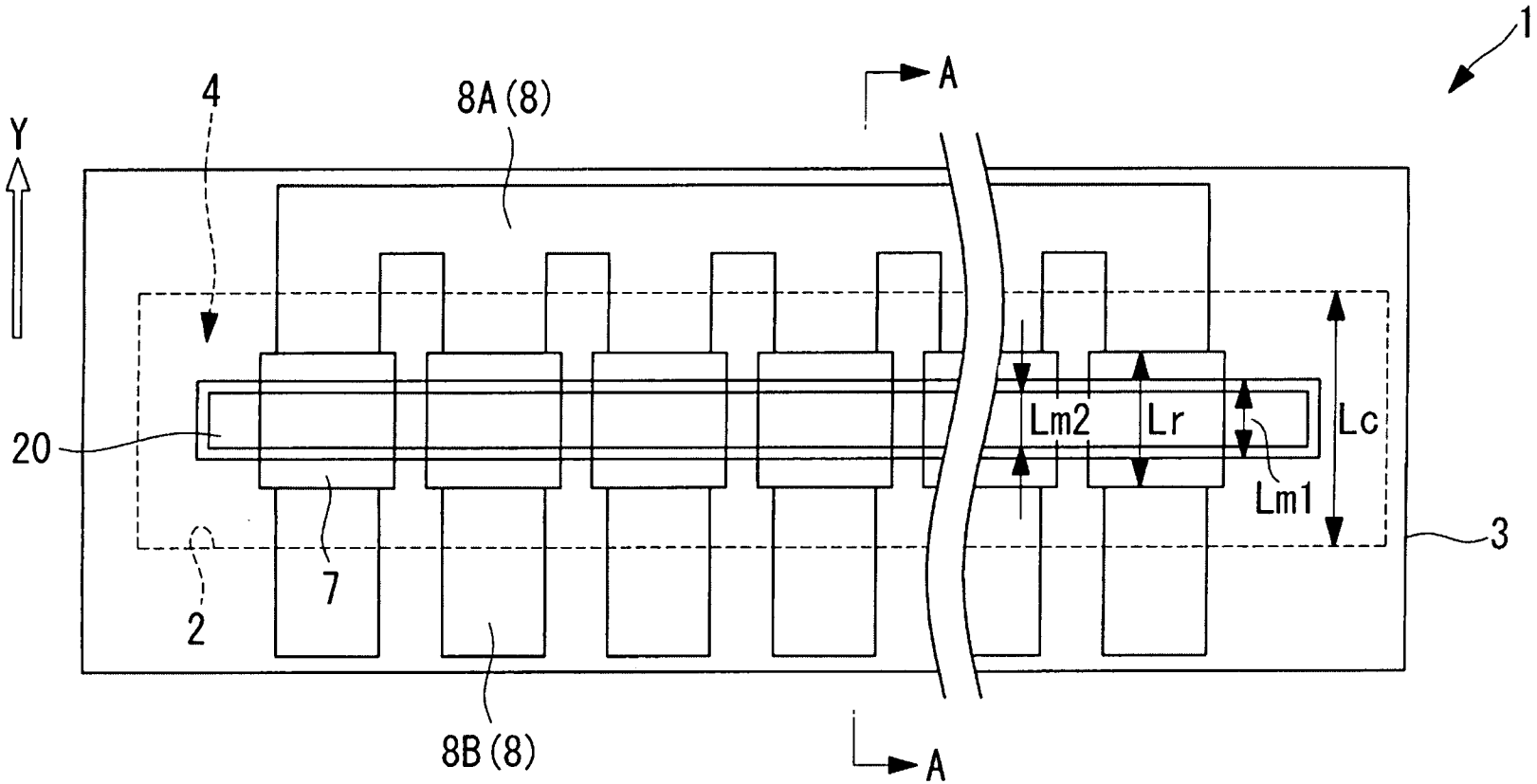
FIG. 2 is a plan view of a thermal head of FIG. 1 viewed from a protective film side.

As illustrated in FIG. 2, in the thermal head 1, a plurality of heating resistors 7 and a plurality of electrode portions 8 are arrayed in a longitudinal direction of a rectangular support substrate 3. The arrow Y represents a feeding direction of the thermal paper 12 by the paper feeding mechanism 17. Further, in a front surface of the support substrate 3, a rectangular concave portion 2 is formed extending in the longitudinal direction of the support substrate 3. Herein, symbols Lr, Lm1, Lm2, and Lc represent a width dimension of each heating portion, a width dimension of a convex portion 20, a width dimension of a distal end surface 21 of the convex portion 20, and a width dimension of the concave portion 2, respectively, which are described later.

Figure 3:
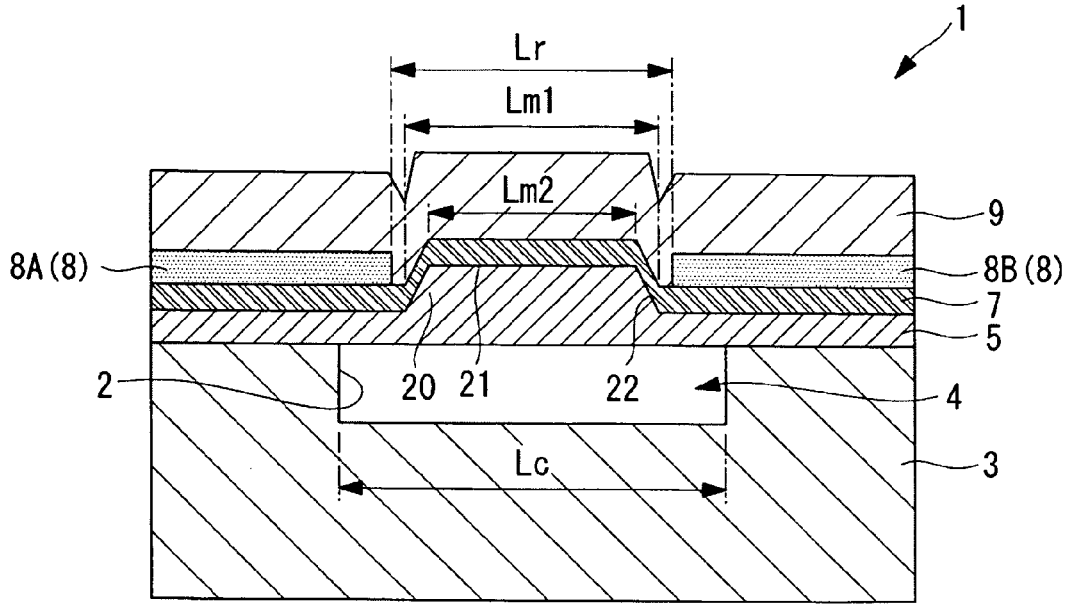
FIG. 3 is a cross-sectional view taken along the arrow A-A of the thermal head of FIG. 2.

FIG. 3 illustrates a cross-section taken along the arrow A-A of FIG. 2.

As illustrated in FIG. 3, the thermal head 1 includes the support substrate 3, an upper substrate 5 bonded to an upper end surface (front surface) of the support substrate 3, the heating resistors 7 provided on the upper substrate 5, the pairs of electrode portions 8 provided on both sides of the heating resistors 7, and a protective film 9 for covering the heating resistors 7 and the electrode portions 8 to protect the heating resistors 7 and the electrode portions 8 from abrasion and corrosion.

The support substrate 3 is, for example, an insulating substrate such as a glass substrate or a silicon substrate having a thickness approximately ranging from 300 μm to 1 mm. In the upper end surface (front surface) of the support substrate 3, that is, at an interface between the support substrate 3 and the upper substrate 5, the rectangular concave portion 2 extending in the longitudinal direction of the support substrate 3 is formed. The concave portion 2 is, for example, a groove with a depth approximately ranging from 1 μm to 100 μm and a width approximately ranging from 50 μm to 300 μm.

The upper substrate 5 is formed of, for example, a glass material with a thickness approximately ranging from 10 μm to 100 μm±5 μm, and functions as a heat storage layer for storing heat generated from the heating resistors 7. The upper substrate 5 is bonded in a stacked state to the front surface of the support substrate 3 so as to hermetically seal the concave portion 2. The concave portion 2 is covered with the upper substrate 5, to thereby form a cavity portion 4 between the upper substrate 5 and the support substrate 3.

The cavity portion 4 has a communication structure opposed to all the heating resistors 7. The cavity portion 4 functions as a hollow heat-insulating layer for preventing the heat, which is generated from the heating resistors 7, from transferring from the upper substrate 5 to the support substrate 3. Because the cavity portion 4 functions as the hollow heat-insulating layer, an amount of heat, which transfers to the above of the heating resistors 7 and is used for printing and the like, may be increased to be more than an amount of heat, which transfers to the support substrate 3 via the upper substrate 5 located under the heating resistors 7. As a result, thermal efficiency of the thermal head 1 may be increased.

The heating resistors 7 are each provided on the upper end surface of the upper substrate 5 so as to straddle the concave portion 2 in its width direction, and are arrayed at predetermined intervals in a longitudinal direction of the concave portion 2. In other words, each of the heating resistors 7 is provided opposite to the cavity portion 4 through the intermediation of the upper substrate 5 so as to be situated above the cavity portion 4.

The electrode portions 8 supply the heating resistors 7 with current to allow the heating resistors 7 to generate heat. The electrode portions 8 include a common electrode 8A connected to one end of each of the heating resistors 7 in a direction orthogonal to the array direction of the heating resistors 7, and individual electrodes 8B connected to another end of each of the heating resistors 7. The common electrode 8A is integrally connected to all the heating resistors 7, and the individual electrodes 8B are connected to each of the heating resistors 7.

When voltage is selectively applied to the individual electrodes 8B, current flows through the heating resistors 7 which are connected to the selected individual electrodes 8B and the common electrode 8A opposed thereto, to thereby allow the heating resistors 7 to generate heat. In this state, the pressure mechanism 19 operates to press the thermal paper 12 against a surface portion (printing portion) of the protective film 9 covering the heating portions of the heating resistors 7, and then color is developed on the thermal paper 12 to be printed.

Note that, of each of the heating resistors 7, an actually heating portion (heating portion) is a portion of each of the heating resistors 7 that the electrode portion 8A or 8B does not overlap, that is, a region of each of the heating resistors 7 between the connecting surface of the common electrode 8A and the connecting surface of each of the individual electrodes 8B, which is situated substantially directly above the cavity portion 4.

Further, as illustrated in FIG. 3, the upper substrate 5 has the convex portion 20 formed in the upper end surface (front surface), on which the heating resistors 7 are provided, between the common electrode 8A and the individual electrodes 8B. The convex portion 20 has the flat distal end surface 21, and side surfaces 22 formed extending and inclining from both ends of the distal end surface 21 so that the convex portion 20 becomes gradually narrower toward the distal end surface 21, i.e., the side surfaces 22 are inclined outwardly in a direction from the distal end surface 21 toward the support substrate 3. In other words, the convex portion 20 is formed such that the width dimension Lm2 of the distal end surface 21 is smaller than the width dimension Lm1 of the convex portion 20. This way, the convex portion 20 has a trapezoidal shape in longitudinal cross-section.

Further, the convex portion 20 is formed such that the width dimension Lm2 is smaller than the width dimension Lc of the concave portion 2. In other words, the convex portion 20 is formed on the upper end side or front side (in the front surface) of the upper substrate 5 within a region corresponding to and overlying the concave portion 2 formed in the support substrate 3. Note that, the convex portion 20 is formed to have a height approximately ranging from, for example, 0.5 μm to 3 μm, which is larger than a thickness of the electrode portions 8.

Now, as a comparative example, a structure of a conventional thermal head 100 is described below.

Figure 14:
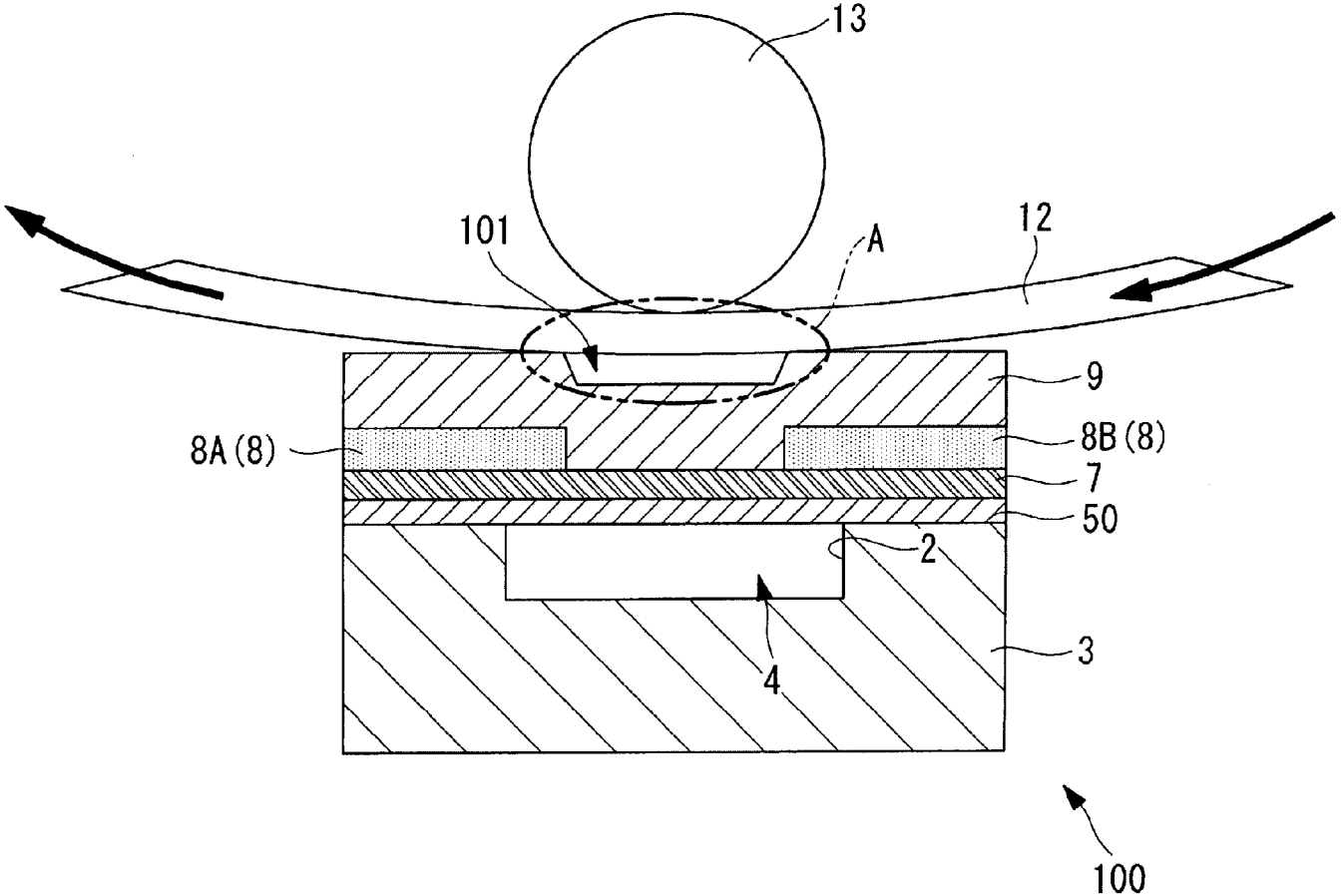
FIG. 14 PRIOR ART
FIG. 14 is a cross-sectional view of a conventional thermal head.

As illustrated in FIG. 14, in the conventional thermal head 100, no convex portion is provided on an upper end side (in a front surface) of an upper substrate 50, and hence steps are defined between the heating resistors 7 and the electrode portions 8 correspondingly to the thickness of the electrode portions 8. Accordingly, also in the front surface of the protective film 9 formed over the heating resistors 7 and the electrode portions 8, steps are defined at positions corresponding to the above-mentioned steps (in a region A illustrated in FIG. 14).

As a result, when the thermal paper 12 is pressed against a surface of the thermal head 100 by the platen roller 13, an air layer 101 is formed between the thermal paper 12 and the surface of the thermal head 100 because of the steps between the heating resistors 7 and the electrode portions 8. The heat generated by the heating resistors 7 is hindered by the air layer 101 from transferring to the thermal paper 12, which is inconvenient because thermal efficiency of the thermal head 100 may decrease.

In contrast, as illustrated in FIG. 3, the thermal head 1 according to this embodiment has the convex portion 20 formed in the front surface of the upper substrate 5 on the electrode portion 8 side between the pairs of electrode portions 8, which are provided on both sides of the heating resistors 7. Accordingly, smaller steps may be defined between the heating resistors 7 formed on the convex portion 20 and the electrode portions 8 provided at both ends of the heating resistors 7. As a result, an air layer to be formed between the surface of the thermal head 1 (protective film 9) and the thermal paper 12 may be reduced in size. Therefore, according to the thermal head 1 of this embodiment, the heat generated by the heating resistors 7 may transfer to the thermal paper 12 efficiently, to thereby increase the thermal efficiency of the thermal head 1 to reduce the amount of energy required for printing.

Further, as illustrated in FIG. 3, the convex portion 20 is formed within the region corresponding to the concave portion 2, and hence the region of the front surface of the upper substrate 5 corresponding to the concave portion 2 (cavity portion 4) may include regions in which the convex portion 20 is not formed, that is, regions in which the upper substrate 5 is thin. Accordingly, the amount of heat to be taken away by the upper substrate 5 may be reduced to increase the thermal efficiency of the thermal head 1.

Still further, as illustrated in FIG. 3, the height of the convex portion 20 is larger than the height of the electrode portions 8, and hence an air layer to be formed between the surface of the thermal head 1 and the thermal paper 12 may be eliminated so that the surface of the thermal head 1 and the thermal paper 12 may adhere closely to each other. Accordingly, the heat generated by the heating resistors 7 may transfer to the thermal paper 12 efficiently, to thereby increase the thermal efficiency of the thermal head 1 to reduce the amount of energy required for printing.

Next, description is given below of how the thermal head 1 according to this embodiment is different in strength from the conventional thermal head 100.

Figure 4A:
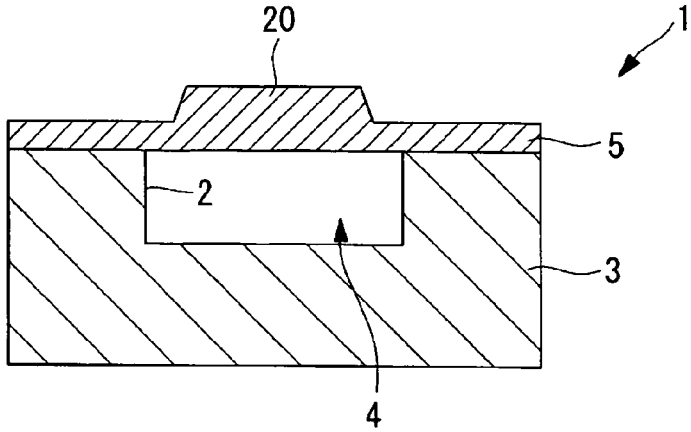
Figure 4B:
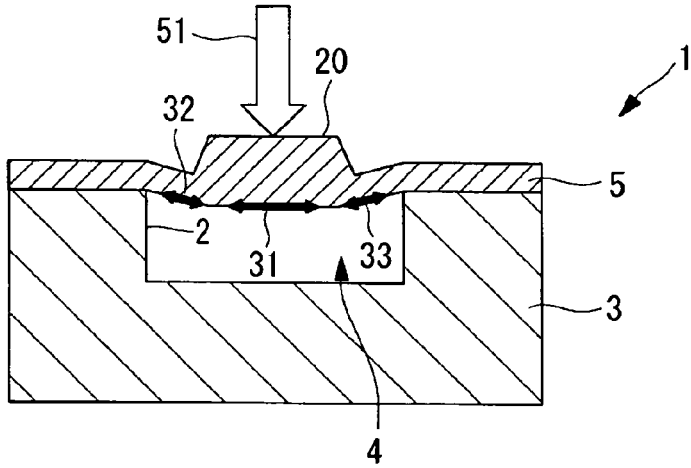
Figure 4C:
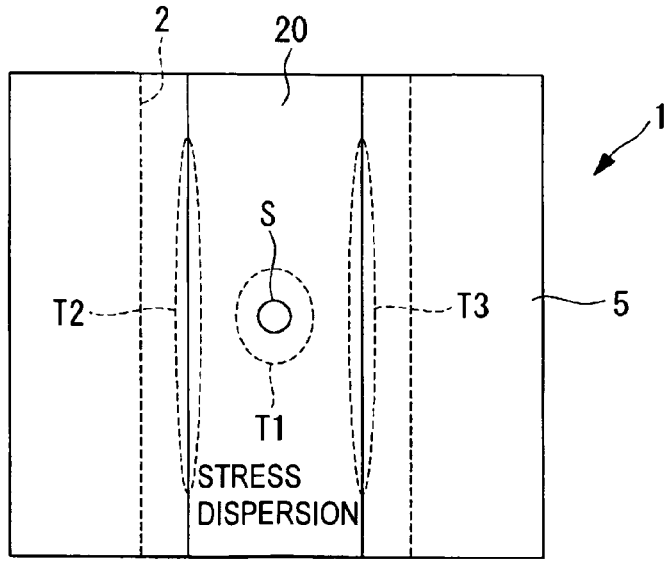
Figure 15A:
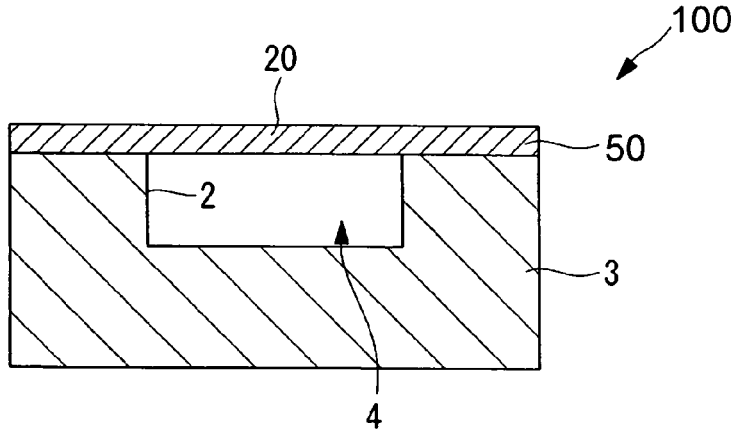
FIG. 15A PRIOR ART
Figure 15B:
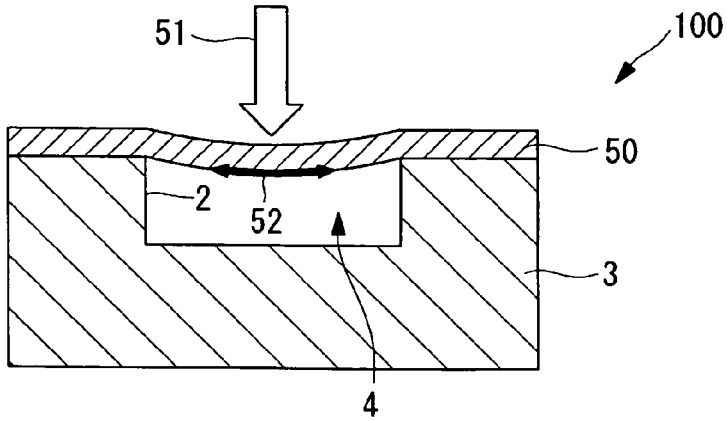
FIG. 15B PRIOR ART
Figure 15C:
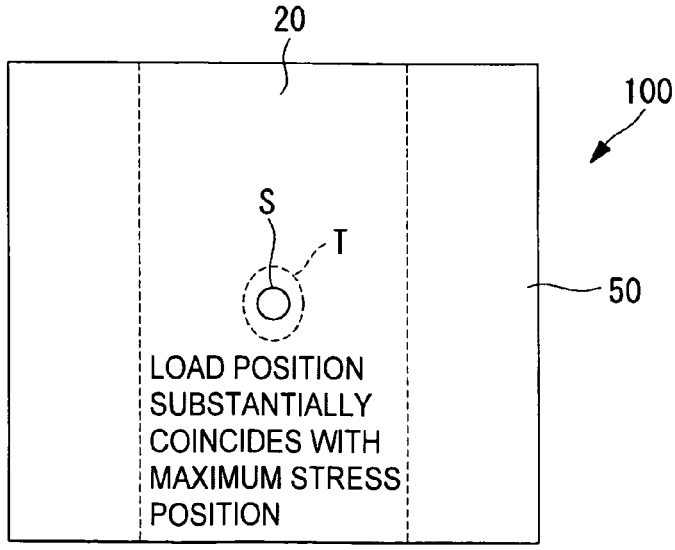
FIG. 15C PRIOR ART

Aimed at describing the difference in strength, FIGS. 4A to 4C and FIGS. 15A to 15C are simplified to illustrate only the upper substrate and the support substrate of the thermal head. FIGS. 4A to 4C illustrate the thermal head 1 according to this embodiment, and FIGS. 15A to 15C illustrate the conventional thermal head 100.

As illustrated in FIG. 15B, in the conventional thermal head 100, when a concentrated load (arrow 51) is applied to the upper substrate 50 above the cavity portion 4, a portion of the upper substrate 50 opposed to the cavity portion 4 is deformed to sink downward. Accordingly, as indicated by an arrow 52 of FIG. 15B, a large tensile stress occurs at a lower end surface (rear surface) of the upper substrate 50, especially at a central position of the applied load. In this case, as illustrated in FIG. 15C, a load position S substantially coincides with a maximum stress position T, with the result that the upper substrate 50 is likely to be broken.

In contrast, as illustrated in FIG. 4A, the thermal head 1 according to this embodiment has the convex portion 20 formed on the upper end side (in the front surface) of the upper substrate 5. Because of such a structure, as illustrated in FIG. 4B, when a concentrated load (arrow 51) is applied to the upper substrate 5 above the cavity portion 4, large tensile stresses (arrows 31, 32, and 33) occur at the lower end surface (rear surface) of the upper substrate 5 at a central position of the applied load and the base portions of the convex portion 20, respectively. Therefore, as illustrated in FIG. 4C, the positions applied with the large stresses are dispersed into regions T1, T2, and T3, respectively.

As described above, unlike the upper substrate 50 with a uniform thickness as illustrated in FIG. 15A, the upper substrate 5 of the thermal head 1 according to this embodiment is thick (as the convex portion 20) at the position corresponding to the cavity portion (concave portion 2). Accordingly, the strength of the upper substrate 5 may be enhanced. Besides, when a concentrated load is applied to the front surface of the upper substrate 5, tensile stresses applied to the front surface of the upper substrate 5 may be dispersed. As a result, the thermal head 1 may be provided as the reliable one being less likely to crack even if a minute foreign matter of several to tens of μm is trapped between the platen roller 13 and the thermal paper 12 to apply a concentrated load to the upper substrate 5, or in other similar cases.

Meanwhile, a material used for the protective film 9 of the thermal head 1 has a significantly large internal stress. For example, a SiAlON film formed by sputtering has an internal stress of 500 to 2,000 MPa. Accordingly, directly above the cavity portion 4 (concave portion 2), the convex portion 20 is provided in the front surface of the upper substrate 5 to increase the plate thickness of the upper substrate 5 so that the strength of the upper substrate 5 is enhanced to prevent the upper substrate 5 from being deformed or broken due to the internal stress of the protective film 9.

Further, the convex portion 20 has the distal end surface 21 that is substantially parallel to the front surface of the upper substrate 5, and hence a load of the platen roller 13 may be imposed over the distal end surface 21 of the convex portion 20, to thereby prevent a concentrated load from being imposed on a part of the convex portion 20. Further, the side surfaces 22 are formed extending and inclining from both ends of the distal end surface 21 so that the convex portion 20 is gradually narrower toward the distal end surface 21. Accordingly, it is easy to form the heating resistors 7 on the side surfaces 22 of the convex portion 20.

Therefore, according to the thermal printer 10 including the above-mentioned thermal head 1, the thermal efficiency of the thermal head 1 may be increased to reduce the amount of energy required for printing. As a result, printing on the thermal paper 12 may be performed with low power to prolong battery duration. Besides, a failure due to the breakage of the upper substrate 5 may be prevented to enhance device reliability.

First Modified Example

A first modified example of the thermal head 1 according to this embodiment is described below. Note that, the description common to the above-mentioned thermal head 1 according to the first embodiment is omitted below, and hence the following description is mainly directed to differences.

Figure 5:
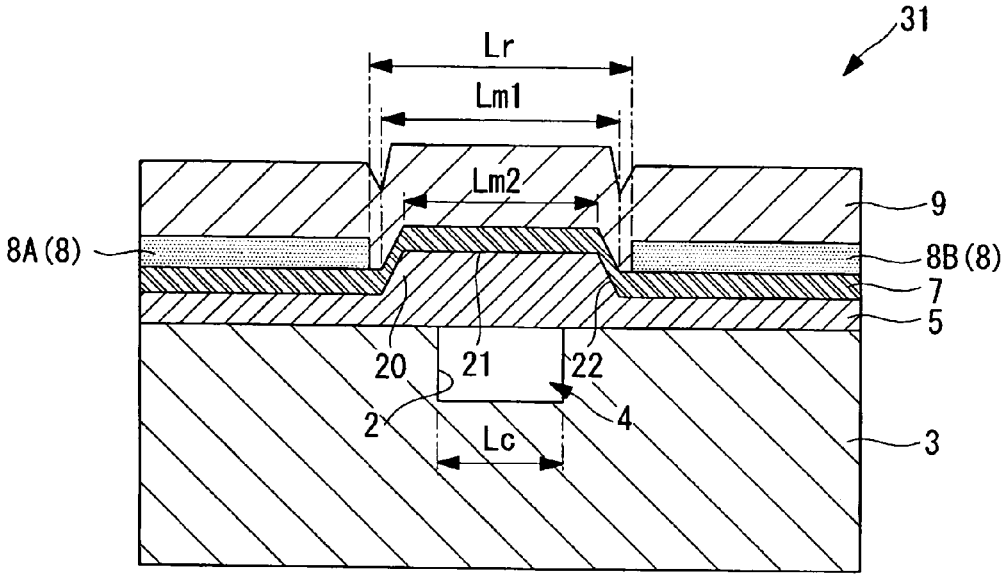
FIG. 5 is a cross-sectional view of a thermal head according to a first modified example of FIG. 3.

As illustrated in FIG. 5, a thermal head 31 according to this modified example has a convex portion 20 formed such that its width dimension Lm2 is larger than the width dimension Lc of the concave portion 2. In other words, on the upper end side (in the front surface) of the upper substrate 5, the convex portion 20 is formed extending to outer regions beyond the region corresponding to the concave portion 2 formed in the support substrate 3.

Such a structure enables the upper substrate 5 to be thickened over the region corresponding to the concave portion 2 (cavity portion 4), to thereby enhance the strength of the upper substrate 5.

Second Modified Example

A second modified example of the thermal head 1 according to this embodiment is described below.

Figure 6:
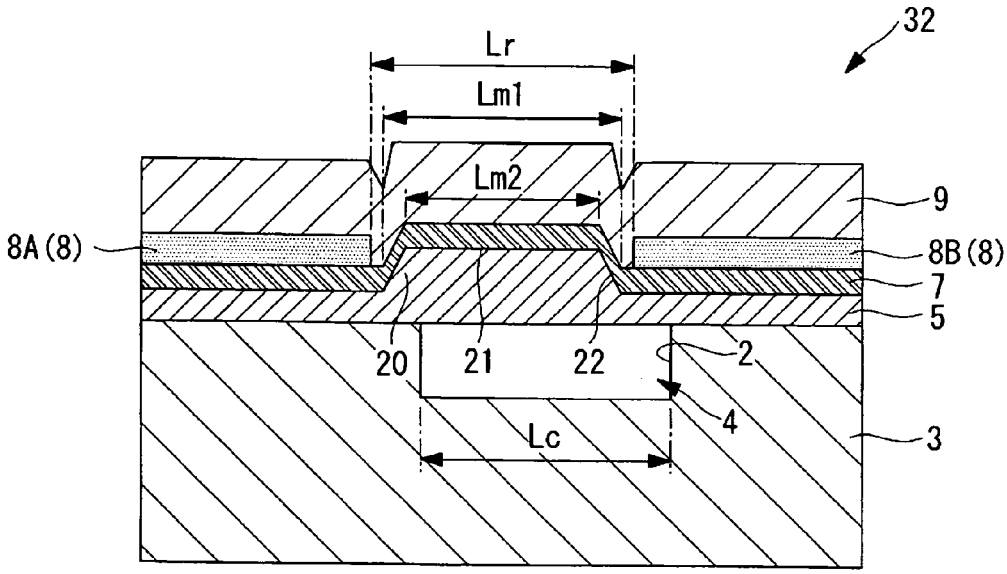
FIG. 6 is a cross-sectional view of a thermal head according to a second modified example of FIG. 3.

As illustrated in FIG. 6, a thermal head 32 according to this modified example has a convex portion 20 formed on the upper end side (in the front surface) of the upper substrate 5 at a position straddling the region corresponding to the concave portion 2 formed in the support substrate 3.

Such a structure enables the upper substrate 5 to be partly thickened within the region corresponding to the concave portion 2 (cavity portion 4) so as to enhance the strength, and to be partly thinned within the region so as to increase the thermal efficiency.

Third Modified Example

A third modified example of the thermal head 1 according to this embodiment is described below.

Figure 7:
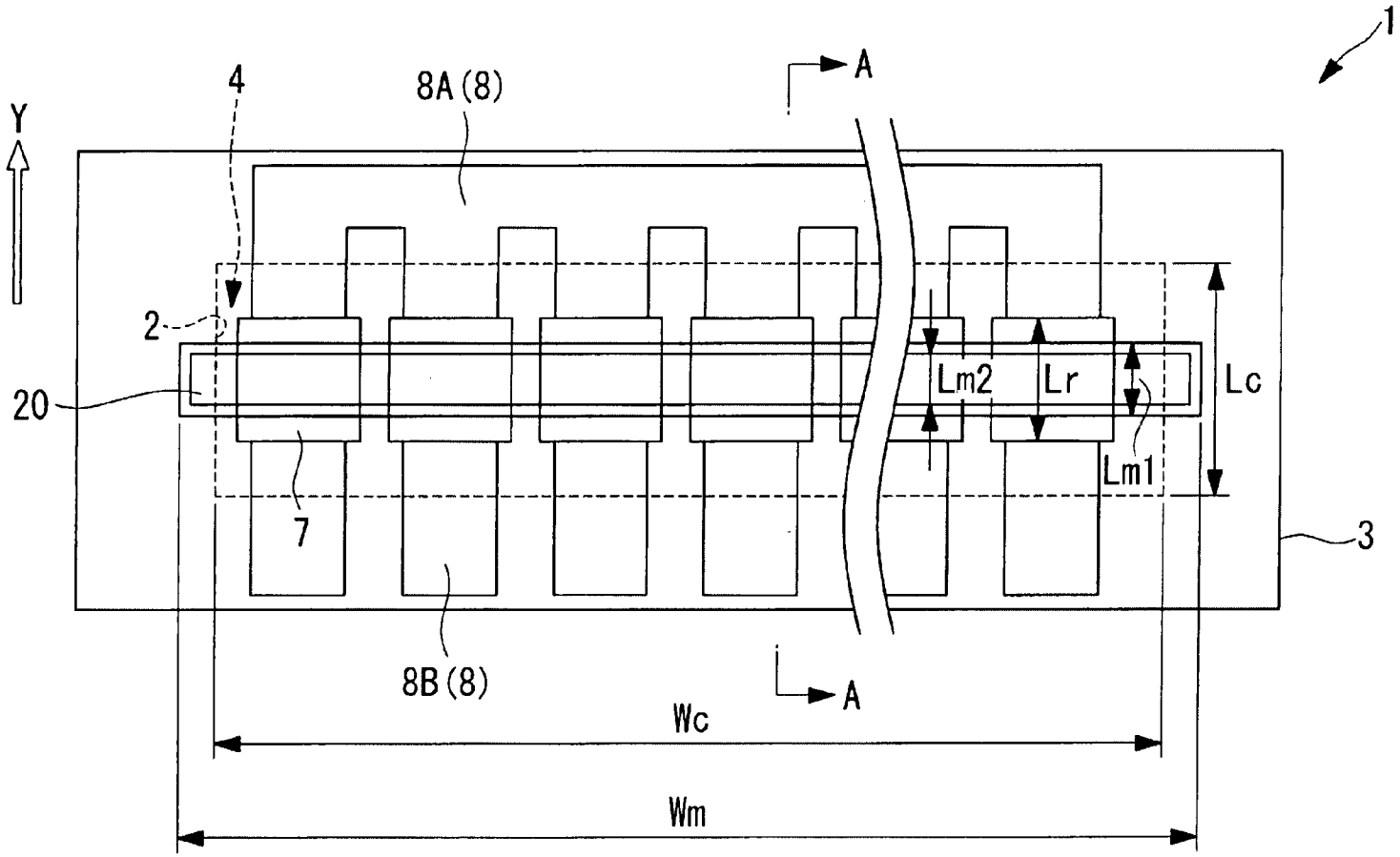
FIG. 7 is a plan view of a thermal head according to a third modified example of FIG. 3 viewed from a protective film side.

As illustrated in FIG. 7, the plurality of heating resistors 7 and the plurality of electrode portions 8 are arrayed in the longitudinal direction of the rectangular support substrate 3. The arrow Y represents the feeding direction of the thermal paper 12 by the paper feeding mechanism 17. Further, in the front surface of the support substrate 3, the rectangular concave portion 2 is formed extending in the longitudinal direction of the support substrate 3. Herein, symbols Lr, Lm1, Lm2, and Lc represent the width dimension of each heating portion, the width dimension of the convex portion 20, the width dimension of the distal end surface 21 of the convex portion 20, and the width dimension of the concave portion 2, respectively.

The convex portion 20 is formed such that its width dimension Lm1 is smaller than the width dimension Lc of the concave portion 2. In other words, the convex portion 20 is formed on the upper end side (in the front surface) of the upper substrate 5 within the region corresponding to the concave portion 2 formed in the support substrate 3.

Regarding a longitudinal dimension of the support substrate 3, on the other hand, the convex portion 20 is formed such that its longitudinal dimension Wm is larger than a longitudinal dimension We of the concave portion 2. In other words, the convex portion 20 has the longitudinal dimension in which the convex portion 20 is formed on the upper end side (in the front surface) of the upper substrate 5 so as to extend to outer regions beyond the region corresponding to the concave portion 2 formed in the support substrate 3.

End portions of the upper substrate 5 in the longitudinal direction of the support substrate 3 are thickened in part to enhance the strength and thinned in part to increase the thermal efficiency.

Fourth Modified Example

A fourth modified example of the thermal head 1 according to this embodiment is described below.

Figure 8:
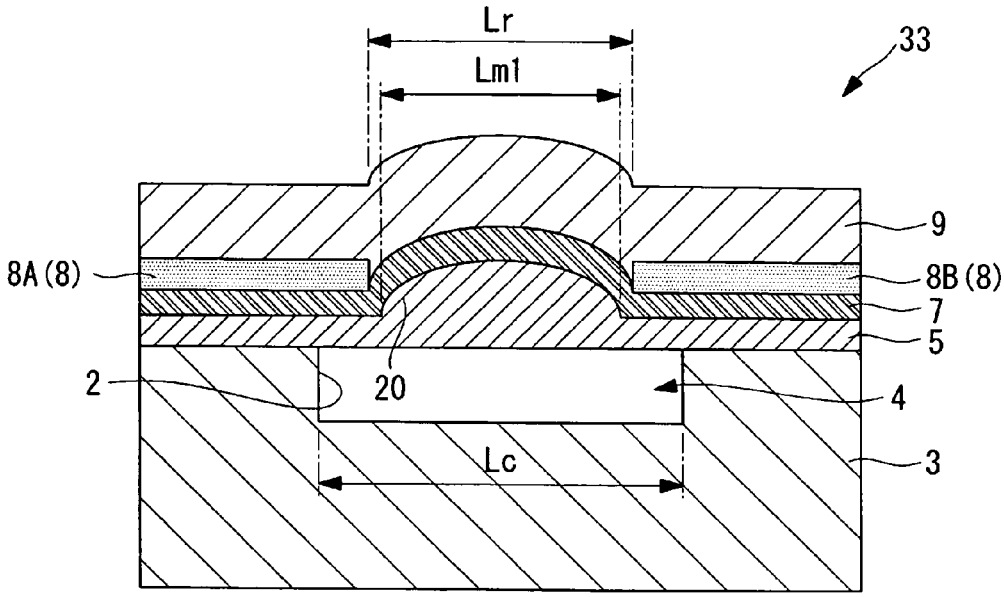
FIG. 8 is a cross-sectional view of a thermal head according to a fourth modified example of FIG. 3.

As illustrated in FIG. 8, a thermal head 33 according to this modified example may have a convex portion 20 formed into a semi-cylindrical shape or a bowl shape.

Also the convex portion 20 formed into such a shape contributes to enhanced strength and increased thermal efficiency compared with the conventional thermal head 100.

Fifth Modified Example

A fifth modified example of the thermal head 1 according to this embodiment is described below.

Figure 9:
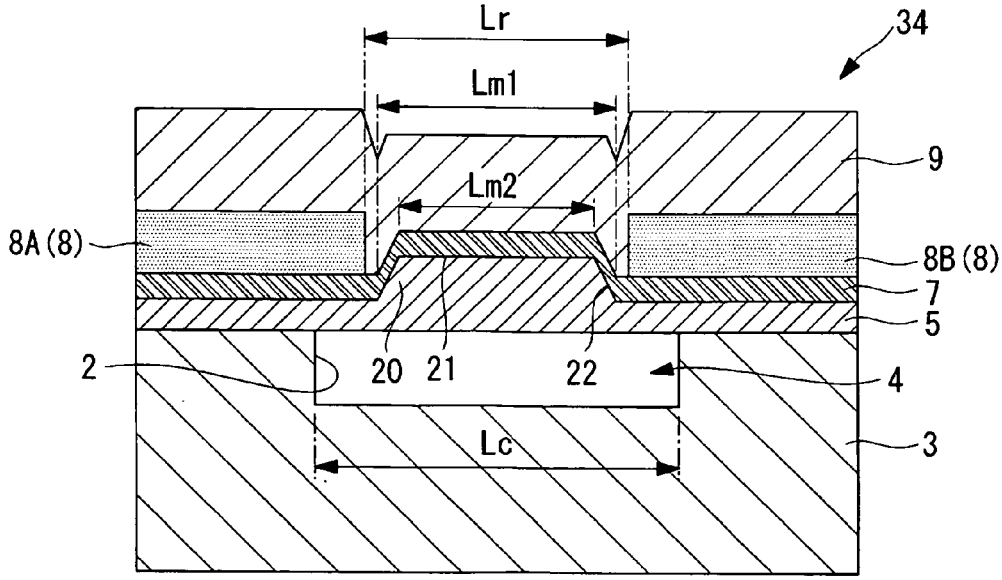
FIG. 9 is a cross-sectional view of a thermal head according to a fifth modified example of FIG. 3.

As illustrated in FIG. 9, a thermal head 34 according to this embodiment has a convex portion 20 formed to have a height smaller than a height of the electrode portions 8. Specifically, the height of the convex portion 20 is determined so that a difference Lh between the height of the convex portion 20 and the thickness of the electrode portions 8 may be equal to or smaller than 0.5 μm, for example.

Such a structure enables a smaller-sized air layer to be formed between the surface of the thermal head 1 and the thermal paper 12 compared with the conventional thermal head 100, and allows the load of the platen roller 13 to be imposed in the regions in which the convex portion 20 is not formed, that is, the regions in which the concave portion 2 (cavity portion 4) is not formed. As a result, the upper substrate 5 may be prevented from being broken while maintaining high thermal efficiency.

Sixth Modified Example

A sixth modified example of the thermal head 1 according to this embodiment is described below.

Figure 10:
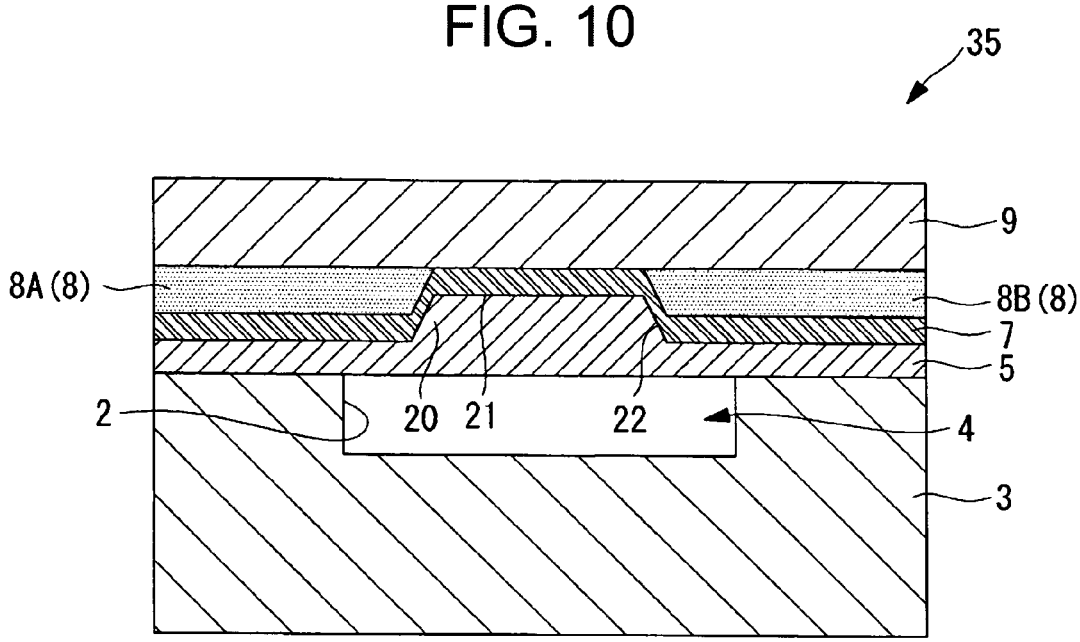
FIG. 10 is a cross-sectional view of a thermal head according to a sixth modified example of FIG. 3.

As illustrated in FIG. 10, a thermal head 34 according to this modified example has a convex portion 20 formed to have a height equal to the thickness of the electrode portions 8.

Such a structure enables eliminating an air layer to be formed between the surface of the thermal head 1 and the thermal paper 12 so that the surface of the thermal head 1 and the thermal paper 12 may adhere closely to each other. Accordingly, the heat generated by the heating resistors 7 may transfer to the thermal paper 12 efficiently, to thereby increase the thermal efficiency of the thermal head 1 to reduce the amount of energy required for printing. Besides, the load of the platen roller 13 may be imposed over the upper substrate 5 so that the stress applied from the platen roller 13 to the convex portion 20 may be reduced to prevent the breakage of the upper substrate 5.

Now, one embodiment of a manufacturing method for the above-mentioned thermal head 1 is described below with reference to FIGS. 11A to 11G.

As illustrated in FIGS. 11A to 11G, the manufacturing method for the thermal head 1 according to this embodiment includes an opening portion forming step of forming an opening portion (concave portion 2) in the front surface of the support substrate 3, a bonding step of bonding the rear surface of the upper substrate 5 in a stacked state to the front surface of the support substrate 3 having the concave portion 2 formed therein, a thinning step of thinning the upper substrate 5 bonded to the support substrate 3, a convex portion forming step of forming the convex portion 20 in the front surface of the upper substrate 5 bonded to the support substrate 3, a resistor forming step of forming the heating resistors 7 on the front surface of the upper substrate 5 in a region corresponding to the cavity portion 4, an electrode layer forming step of forming the electrode portions 8 at both ends of the heating resistors 7, and a protective film forming step of forming the protective film 9 over the electrode portions 8. Hereinafter, the above-mentioned steps are specifically described.

Figure 11A:
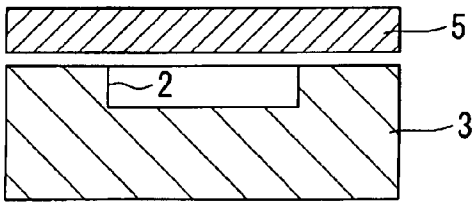

In the opening portion forming step, as illustrated in FIG. 11A, in the upper end surface (front surface) of the support substrate 3, the concave portion 2 is formed at a position corresponding to a region of the upper substrate 5, in which the heating resistors 7 are to be provided. The concave portion 2 is formed in the front surface of the support substrate 3 by performing, for example, sandblasting, dry etching, wet etching, or laser machining.

In the case where sandblasting is performed on the support substrate 3, the front surface of the support substrate 3 is covered with a photoresist material, and the photoresist material is exposed to light using a photomask of a predetermined pattern so as to be cured in part other than the region for forming the concave portion 2. After that, the front surface of the support substrate 3 is cleaned and the uncured photoresist material is removed to obtain etching masks (not shown) having etching windows formed in the region for forming the concave portion 2. In this state, sandblasting is performed on the front surface of the support substrate 3 to form the concave portion 2 at a depth ranging from 1 μm to 100 μm. It is preferable that the depth of the concave portion 2 be, for example, 10 μm or more and half or less of the thickness of the support substrate 3.

In the case where etching such as dry etching and wet etching is performed, as in the case of sandblasting, the etching masks having the etching windows formed in the region for forming the concave portion 2 are formed on the front surface of the support substrate 3. In this state, etching is performed on the front surface of the support substrate 3 to form the concave portion 2 at a depth ranging from 1 μm to 100 μm.

As such an etching process, for example, wet etching using hydrofluoric acid-based etchant or the like is available as well as dry etching such as reactive ion etching (RIE) and plasma etching. Note that, as a reference example, in a case of a single-crystal silicon support substrate, wet etching is performed using an etchant such as a tetramethylammonium hydroxide solution, a KOH solution, or a mixed solution of hydrofluoric acid and nitric acid.

Figure 11B:
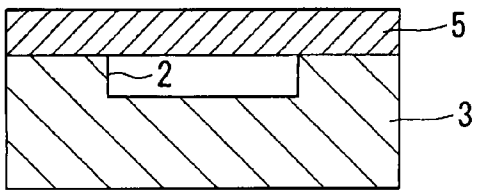

Next, in the bonding step, as illustrated in FIG. 11B, the lower end surface (rear surface) of the upper substrate 5, which is a glass substrate or the like having a thickness approximately ranging from 500 μm to 700 μm, for example, and the upper end surface (front surface) of the support substrate 3 having the concave portion 2 formed therein are bonded to each other by high temperature fusing or anodic bonding. At this time, the support substrate 3 and the upper substrate 5 are bonded to each other in a dry state, and the substrates thus bonded to each other are subjected to heat treatment at a temperature equal to or higher than 200° C. and equal to or lower than softening points thereof, for example.

After the support substrate 3 and the upper substrate 5 are bonded to each other, the concave portion 2 formed in the support substrate 3 is covered with the upper substrate 5 to form the cavity portion 4 between the support substrate 3 and the upper substrate 5.

Here, it is difficult to manufacture and handle an upper substrate having a thickness of 100 μm or less, and such a substrate is expensive. Thus, instead of directly bonding an originally thin upper substrate 5 onto the support substrate 3, the upper substrate 5 thick enough to be easily manufactured and handled in the bonding step is bonded onto the support substrate 3, and then the upper substrate 5 is processed in the thinning step so as to have a desired thickness.

Figure 11C:
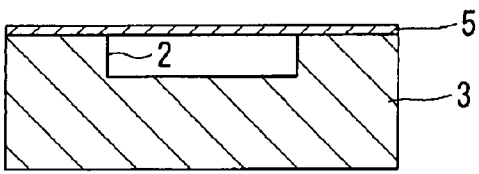

Next, in the thinning step, as illustrated in FIG. 11C, mechanical polishing is performed on the upper end surface (front surface) of the upper substrate 5 to process the upper substrate 5 to be thinned to, for example, about 1 μm to 100 μm. Note that, the thinning process may be performed by dry etching, wet etching, or the like.

Figure 11D:
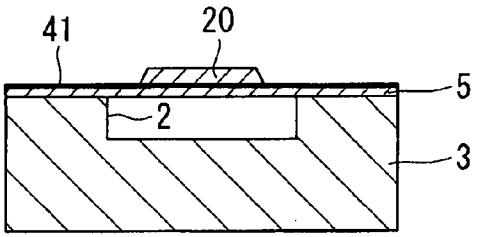

Next, in the convex portion forming step, as illustrated in FIG. 11D, dry etching, wet etching, or the like is performed to form the convex portion 20 in the upper end surface (front surface) of the upper substrate 5 in the region corresponding to the concave portion 2 formed in the support substrate 3. Note that, the convex portion forming step may be performed simultaneously with the thinning step. In other words, in the above-mentioned thinning step, with the region for forming the convex portion 20 covered with a resist material, dry etching, wet etching, or the like may be performed to form the convex portion 20 simultaneously with the thinning of the upper substrate 5.

Next, the heating resistors 7, the common electrode 8A, the individual electrodes 8B, and the protective film 9 are successively formed on the upper substrate 5.

Figure 11E:
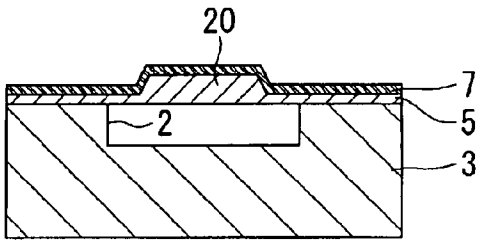

Specifically, in the resistor forming step, as illustrated in FIG. 11E, a thin film forming method such as sputtering, chemical vapor deposition (CVD), or vapor deposition is used to form a thin film of a heating resistor material on the upper substrate 5, such as a Ta-based thin film or a silicide-based thin film. The thin film of the heating resistor material is molded by lift-off, etching, or the like to form the heating resistors 7 having a desired shape.

Figure 11F:
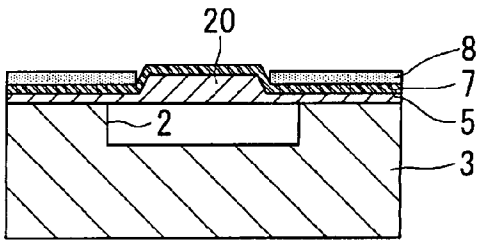

Next, in the electrode layer forming step, as illustrated in FIG. 11F, a film of a wiring material such as Al, Al—Si, Au, Ag, Cu, or Pt is deposited on the upper substrate 5 by sputtering, vapor deposition, or the like. Then, the film thus obtained is formed by lift-off or etching, or alternatively the wiring material is baked after screen-printing, to thereby form the common electrode 8A and the individual electrodes 8B having desired shapes. Note that, in order to pattern a resist material for the lift-off or etching for the heating resistors 7 and the electrode portions 8A and 8B, a photoresist material is patterned using a photomask.

Figure 11G:
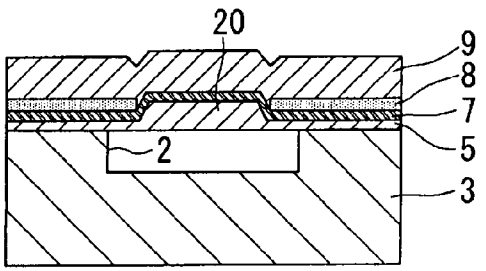

Next, in the protective film forming step, as illustrated in FIG. 11G, a film of a protective film material such as $SiO_2$, $Ta_2O_5$, SiAlON, $Si_3N_4$, or diamond-like carbon is deposited on the upper substrate 5 by sputtering, ion plating, CVD, or the like to form the protective film 9. This way, the thermal head 1 illustrated in FIG. 3 is manufactured.

According to the manufacturing method for the thermal head 1, the thermal head 1 may be manufactured, in which the cavity portion 4 is formed between the support substrate 3 and the upper substrate 5, and the convex portion 20 is formed between the electrode portions 8 formed at both ends of the heating resistors 7. This way, as described above, while ensuring the strength of the upper substrate 5, the thermal efficiency of the thermal head 1 may be increased to reduce the amount of energy required for printing.

First Modified Example

A first modified example of the manufacturing method for the thermal head 1 according to this embodiment is described below.

The manufacturing method for the thermal head 1 according to this modified example is different from the above-mentioned manufacturing method for the thermal head 1 according to the second embodiment in that the convex portion 20 is formed in a layered manner in the convex portion forming step. Hereinafter, the description common to the manufacturing method for the thermal head 1 according to the second embodiment is omitted, and hence the following description is mainly directed to differences.

Figure 12A:
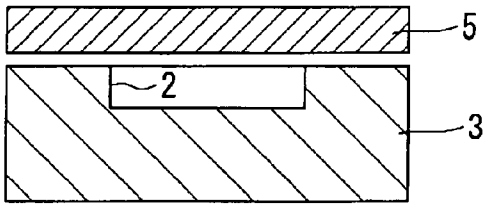
Figure 12B:
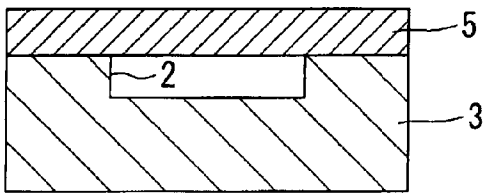
Figure 12C:
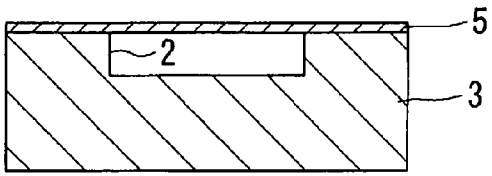

In the thinning step, as illustrated in FIG. 12C, dry etching or wet etching is performed on the upper end surface (front surface) of the upper substrate 5 so that the upper substrate 5 may be processed to have a thickness approximately ranging from, for example, 1 μm to 100 μm, to thereby obtain sufficient heat-insulating properties.

Figure 12D:
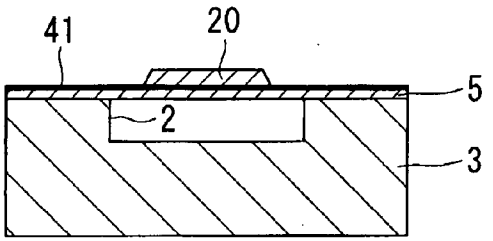
Figure 12E:
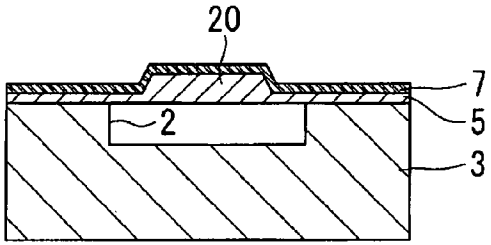
Figure 12F:
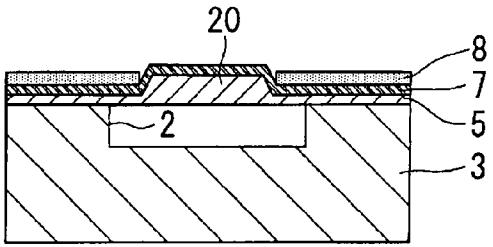
Figure 12G:
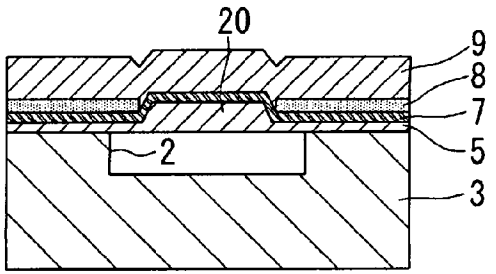

In the convex portion forming step, as illustrated in FIG. 12D, an etching stop layer 41 and a material for forming the convex portion 20, such as $SiO_2$ or glass, are formed on the upper substrate 5 already thinned in the thinning step. Then, portions other than the convex portion 20 are removed by dry etching, wet etching, or the like to form the convex portion 20 in the upper end surface (front surface) of the upper substrate 5. This way, the convex portion 20 may be formed with the upper substrate 5 keeping having a thickness determined in the thinning step (keeping unchanged).

In this step, the etching stop layer 41 and the material for forming the convex portion 20 are successively formed, to thereby prevent overetching during the patterning of the convex portion 20, and hence the convex portion 20 may be formed at an accurate height. As the etching stop layer 41, a material exhibiting a slow etching rate compared with $SiO_2$ and glass is selected. In the case of dry etching using a CF-based gas, MgO, $Ta_2O_5$, or the like may be used.

Second Modified Example

A second modified example of the manufacturing method for the thermal head 1 according to this embodiment is described below.

The manufacturing method for the thermal head 1 according to this modified example is different from the above-mentioned manufacturing method for the thermal head 1 according to the second embodiment in the different orders of the thinning step and the convex portion forming step.

Figure 13A:
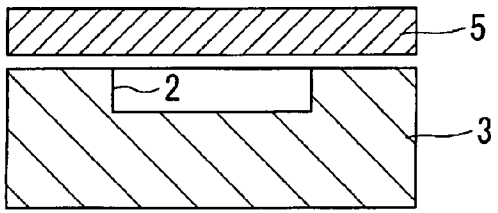
Figure 13B:
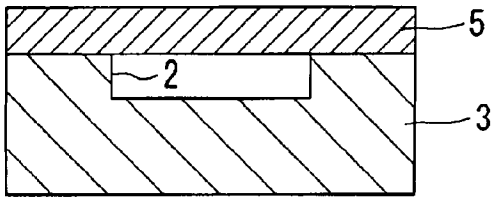
Figure 13C:
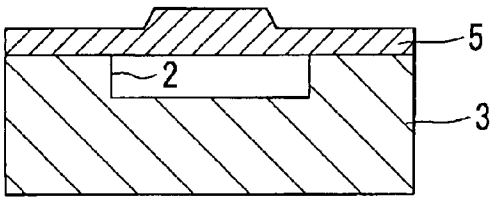
Figure 13D:
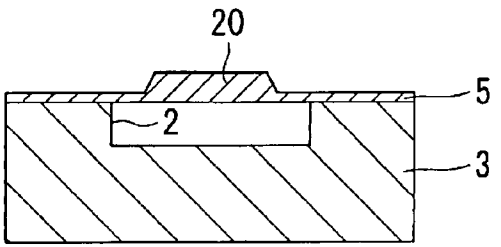
Figure 13E:
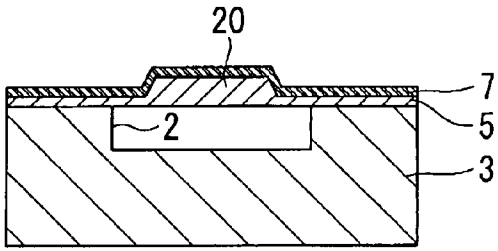
Figure 13F:
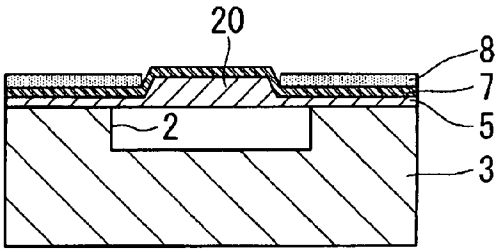
Figure 13G:
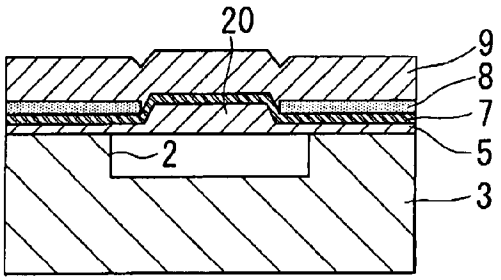

In the convex portion forming step, as illustrated in FIG. 13D, dry etching, wet etching, or the like is performed to form the convex portion 20 in the upper end surface (front surface) of the upper substrate 5 in the region corresponding to the concave portion 2 formed in the support substrate 3.

In the thinning step, as illustrated in FIG. 13C, dry etching or wet etching is performed on the upper end surface (front surface) of the upper substrate 5 so that the upper substrate 5 may be processed to have a thickness approximately ranging from, for example, 1 μm to 100 μm. By performing the thinning in this way, the upper substrate 5 may be thinned while the shape of the convex portion 20 formed in the convex portion forming step remains unchanged.

Hereinabove, the embodiments of the present invention have been described in detail with reference to the accompanying drawings. However, specific structures of the present invention are not limited to those embodiments, and include design modifications and the like without departing from the gist of the present invention.

For example, although the description has been given of the convex portion 20 having a trapezoidal or bowl shape in longitudinal cross-section, the convex portion 20 may be formed into any other shape in longitudinal cross-section, such as a rectangular shape, as long as the heating resistors 7 may be formed.

Further, the rectangular concave portion 2 extending in the longitudinal direction of the support substrate 3 is formed, and the cavity portion 4 has the communication structure opposed to all the heating resistors 7, but as an alternative thereto, concave portions independent of one another may be formed in the longitudinal direction of the support substrate 3 at positions opposed to the heating resistors 7, and cavity portions independent for each concave portion may be formed through closing the respective concave portions by the upper substrate 5. In this manner, a thermal head including a plurality of hollow heat-insulating layers independent of one another may be formed.

What is claimed is:

1. A thermal head, comprising:

a support substrate having a concave portion formed in a front surface thereof;

an upper substrate bonded in a stacked state to the front surface of the support substrate;

a heating resistor provided on a front surface of the upper substrate at a position corresponding to the concave portion;

a pair of electrodes provided on opposite sides of the heating resistor; and a convex portion formed in the front surface of the upper substrate on a side of the pair of electrodes, the convex portion being provided between the pair of electrodes, wherein the heating resistor has a heating portion which is disposed between and not overlapped by the pair of electrodes and which overlies the concave portion, and wherein the convex portion has a width dimension smaller than that of the heating portion.

2. A thermal head according to claim 1, wherein the convex portion is formed within a region corresponding to the concave portion.

3. A thermal head according to claim 1, wherein the convex portion extends to outer regions beyond a region corresponding to the concave portion.

4. A thermal head according to claim 1, wherein the convex portion has a flat distal end surface, and side surfaces extending and inclining from both ends of the distal end surface so that the convex portion is gradually narrower toward the distal end surface.

5. A thermal head according to claim 1, wherein the convex portion has a height larger than a height of the pair of electrodes.

6. A printer, comprising the thermal head according to claim 1.

7. A manufacturing method for a thermal head, comprising:

forming an opening portion in a front surface of a support substrate;

bonding a rear surface of an upper substrate in a stacked state to the front surface of the support substrate, which has the opening portion formed therein;

thinning the upper substrate which is bonded to the support substrate;

forming a convex portion in the front surface of the upper substrate which is bonded to the support substrate;

forming a heating resistor on the front surface of the upper substrate in a region corresponding to the opening portion; and forming electrode layers at both ends of the heating resistor such that the electrode layers do not overlap a heating portion of the heating resistor that substantially directly overlies the concave portion, wherein the convex portion is formed to have a width dimension smaller than the width dimension of the heating portion.

8. A thermal head, comprising:

a support substrate having a concave portion formed in a front surface thereof;

an upper substrate bonded in a stacked state to the front surface of the support substrate so as to cover the concave portion and form a hollow cavity portion between the support substrate and the upper substrate, the upper substrate having a convex portion on a front side thereof that overlies the concave portion of the support substrate;

a heating resistor provided on a front surface of the upper substrate including the front surface of the convex portion; and two electrodes provided on the heating resistor on opposite sides of the convex portion in a width direction of the thermal head, wherein the heating resistor has a heating portion which is disposed between and not overlapped by the pair of electrodes and which overlies the concave portion, and wherein the convex portion has a width dimension smaller than that of the heating portion.

9. A thermal head according to claim 8; wherein the convex portion completely overlies the concave portion in the width direction.

10. A thermal head according to claim 8; wherein the convex portion partly overlies the concave portion in the width direction.

11. A thermal head according to claim 8; wherein the convex portion has a height larger than the height of each of the two electrodes.

12. A thermal head according to claim 8; wherein the convex portion has a flat distal end surface, and side surfaces that are inclined outwardly in a direction from the flat distal end surface toward the support substrate.

13. A thermal head according to claim 8; wherein the concave portion has a larger width than that of the convex portion.

14. A thermal head according to claim 8; wherein the convex portion has a larger width than that of the concave portion.

15. A thermal head according to claim 8; wherein the convex portion has a curved shape.

16. A thermal head according to claim 8; wherein the convex portion has a trapezoidal shape when viewed in cross section in a length direction of the thermal head.

17. A thermal head according to claim 8; wherein the height of the convex portion is the same as the height of each of the two electrodes.

18. A printer that includes the thermal head of claim 8.

* * * * *